United States Patent [19]

Folland

[11] Patent Number: 4,501,311

[45] Date of Patent: Feb. 26, 1985

[54] SYSTEM FOR PRODUCTION OF ROMAN TYPE SHADES

[76] Inventor: Glenn A. Folland, 405 Cedar Ave., Minneapolis, Minn. 55454

[21] Appl. No.: 544,365

[22] Filed: Oct. 21, 1983

[51] Int. Cl.[3] ..... E06B 9/00

[52] U.S. Cl. ..... 160/127

[58] Field of Search ..... 160/127, 123, 330; 29/811

[56] References Cited

U.S. PATENT DOCUMENTS

| | | |
|---|---|---|
| 695,699 | 3/1902 | Peterson . |
| 944,721 | 12/1909 | Edsall . |
| 1,693,536 | 11/1928 | Woodley . |
| 1,945,932 | 2/1934 | Caley . |
| 2,087,756 | 7/1937 | Farkas . |
| 3,103,666 | 9/1963 | Bone . |
| 3,110,647 | 11/1963 | Tong . |
| 3,300,827 | 1/1967 | Hutton . |
| 3,380,122 | 4/1968 | Kirk . |
| 3,399,432 | 9/1968 | Merser . |
| 3,444,597 | 5/1969 | Bone . |
| 3,470,834 | 10/1969 | Bone . |
| 3,494,004 | 2/1970 | Bone . |
| 3,533,890 | 10/1970 | Nesbit . |
| 3,660,872 | 5/1972 | Kawano . |
| 3,680,178 | 8/1972 | Kawano . |
| 3,694,864 | 10/1972 | Kawano . |
| 3,733,657 | 5/1973 | Lankton . |
| 3,850,297 | 11/1974 | Merser . |
| 4,229,930 | 10/1980 | Ostermaier . |

OTHER PUBLICATIONS

Lindahl, Judy, *The Shade Book—How to Make Roman, Balloon, and Austrian Shades,* 3211 N.E. Siskiyou, Portland, OR 97212, copyright 1978, revised copyright 1980—Tenth Printing.

Lindahl, Judy, *Energy Saving Decorating,* 3211 N.E. Siskiyou, Portland, OR 97212, Copyright 1981, Third Printing.

*Do It Yourself Beautifully . . . Instructions to Make Insulated Roman Shades, The Warm Window,* 8288 Lake City Way N.E., Seattle, Washington 98115.

*Primary Examiner*—Peter M. Caun

*Attorney, Agent, or Firm*—Wicks & Nemer

[57] ABSTRACT

A system for production of Roman type shades formed of multilayers of material is shown according to the teachings of the preferred embodiment of the present invention. Generally, Roman type shades include pulling cords strung through rings attached to the shade such that the shade is generally flat when down and the shade falls into pleats when the pulling cords are pulled. The system of the present invention includes an array of linearly connected ring connectors for automatic distribution and insertion by an attachment tool. The ring connectors include a T-shaped member having a shank portion connected between the shade ring and a crossbar member. The crossbar may be aligned in the attachment tool with and for introduction into the hollow needle of the attachment tool. Therefore, after the needle has been inserted through the shade, the crossbar may be forced into and through the needle moving the crossbar of the ring connector in and through the needle for inserting the shank portion of the ring connector through the multilayers of the shade and for positioning the crossbar to be parallel and abut with the multilayers of the shades. In the preferred form, the ring connectors are held in the array by a carrier bar having a multiplicity of integrally formed tongues attached to the crossbars of the ring connectors.

5 Claims, 5 Drawing Figures

SYSTEM FOR PRODUCTION OF ROMAN TYPE SHADES

BACKGROUND

The present invention relates generally to Roman type shades and more specifically to a system for production of Roman type shades.

With the increasing awareness of energy conservation, a need has arisen for window coverings which reduce heat transfer from inside a building to outside the building during winter and for preventing heat transfer from the outside of the building to the inside of the building during summer. Roman type shades are within the class of window coverings which accomplish this purpose. Furthermore, due to its aesthetic qualities and other attributes, Roman type shades are a preferred type within the class of window coverings having energy conservation considerations. Therefore, a need has arisen for an improved system for production of Roman type shades.

SUMMARY

The present invention solves this need by providing a ring connector which is integrally formed with the pulling cord ring of a Roman type shade. The ring connectors are linearly connected for automatic distribution in an array and include a T-shaped member having a shank portion integrally attached to the pulling cord ring and a crossbar. The ring connectors are connected in the array by a carrier bar having a multiplicity of integrally formed tongues integrally attached to the crossbars of the ring connectors. The system further includes an attachment tool having a hollow needle including an elongated slot. Therefore, the array of linearly connected, automatically distributing, ring connectors may be fed to the hollow needle of the attachment tool for aligning the crossbar of the ring connector generally parallel to, aligned with, and for introduction into the hollow needle and for aligning the shank portion with and for introduction into the slot of the hollow needle. After the needle of the attachment tool is inserted through the shade, the crossbar of the ring connector may be forced into and through the needle moving the shank portion of the ring connector into and through the slot of the hollow needle for inserting the shank portion of the ring connector through the multilayers of material and for positioning the crossbar to be parallel and abut with the multilayers of shade material on the opposite side of the material from the ring for preventing the shank portion of the ring connector from being pulled from the shade by the abutment of the crossbar with the shade material and thus firmly attaching the pulling cord ring to the Roman shade material in a one step operation.

Thus, it is an object of the present invention to provide a novel system for production of Roman type shades.

It is also an object of this invention to provide such a novel system which provides a one step process for attaching pulling cord rings to a Roman type shade.

It is also an object of this invention to provide such a novel system where the pulling cord rings can be attached in a very inexpensive, efficient, accurate, and less time consuming manner.

It is also an object of this invention to provide such a novel system which does not require a sewing machine or other expensive machinery for attaching pulling cord rings to the shade.

It is also an object of this invention to provide such a novel system where the shade can remain flat on the table at all times so that there is no shifting in the layers of the shade.

It is also an object of this invention to provide such a novel system which is applicable to all types and styles of Roman shades.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings, where.

Figure 1:
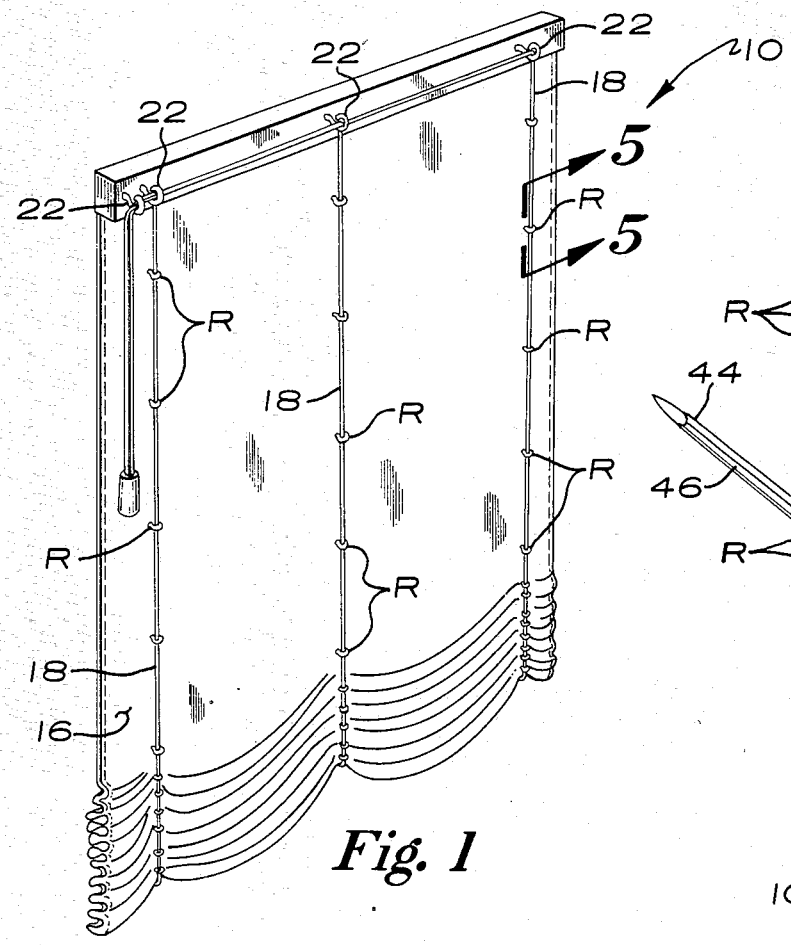
FIG. 1 shows a perspective view of an example of a Roman type shade constructed according to the system of the present invention.
Figure 3:
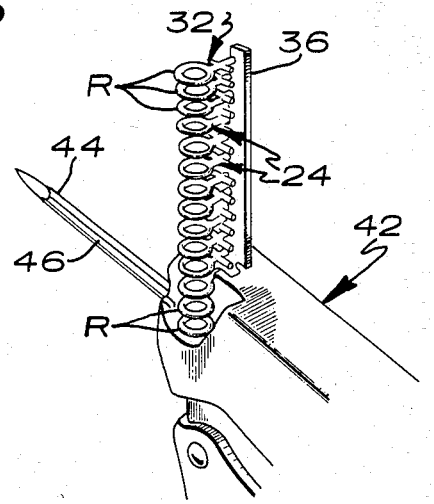
FIG. 3 shows a perspective view of the array of connectors of FIG. 2 in an attachment tool according to the teachings of the present system invention.
Figure 2:
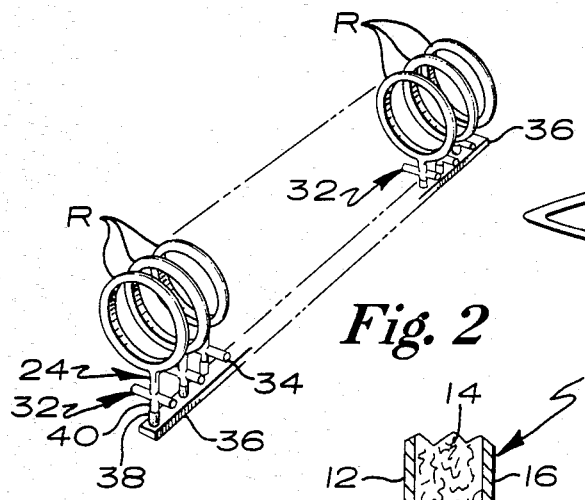
FIG. 2 shows a perspective view of an array of linearly connected, automatically distributing ring connectors constructed according to the teachings of the present system invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms, "top", "bottom", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

The present invention relates generally to window coverings of the Roman-shade type, an example of which is shown in the Figures and generally designated 10. Examples of Roman shades are shown and described by books written by Judy Lindahl and entitled *The Shade Book—How To Make Roller, Roman, Balloon, And Austrian Shades* and *Energy Saving Decorating.* Generally, shades 10 are formed of multilayers of material such as a decorator fabric 12, batting material 14, and lining 16. Shade 10 further includes pulling cords 18 which are strung through rings R and which have their ends attached to screw eyes or pulleys 22. Therefore, shade 10 is generally flat when down, but when cords 18 are pulled, shade 10 falls into pleats.

Problems have then arisen in the method of attaching rings R to shade 10. Prior to the present invention, one of the traditional methods of attaching rings R to shades 10 was hand sewing of the rings R to shade 10. However, hand sewing of rings R presented several problems and was otherwise disadvantageous. Specifically, handsewing was very time consuming. Further, it was very difficult to keep all layers of materials flat and even such that the layers did not shift during hand sewing of the ring. Furthermore, especially with large shades for very large window openings, it is very difficult to manage hand sewing on large quantities of fabric. Additionally, hand sewing required some degree of agility with the fingers of the sewer and therefore people with larger hands or with restricted use of the fingers found it difficult to hand sew the rings. Likewise, since it was necessary to sew through the shade 10, it was often difficult to find rings R located on the opposite side of shade 10. Thus, hand sewing of rings R on shades 10 is disadvantageous.

Another traditional method of attaching rings R to shade 10 is sewing ring R to shade 10 by a zigzag button stitch with a sewing machine. Although machine sewing is faster than hand sewing, machine sewing of rings R also presented problems and was otherwise disadvantageous. First, this method required a machine with the capabilities of performing this sewing operation. Specifically, a sewing machine is required which performs a zigzag stitch and which is able to handle the multiple layers of material of shade 10 while maintaining the correct tension setting for the multiple layers. Thus, the overhead of production was increased due to the very expensive nature of a sewing machine of these requirements. Furthermore, it should be appreciated that a high degree of skill is necessary in performing this sewing function especially because of the difficulty in managing multiple layers of material and large size work pieces under a sewing machine. Further, it is very difficult to maintain accuracy in placement of rings R on shade 10. Thus, machine sewing of rings R on shade 10 is similarly disadvantageous.

Sewing of the rings R to shade 10 by hand sewing and by sewing a zigzag stitch with a sewing machine is discussed in *The Shade Book—How To Make Roller, Roman, Balloon, And Austrian Shades* at least at pages 78 and 79 and *Energy Saving Decorating* at least at pages 62 and 66.

Another method of securing rings R to shade 10 is by the utilization of ring tape. Ring tape is a special notion with pre-spaced rings R sewn to a twill tape, which can then be sewn to shade 10. This method is described in *The Shade Book—How To Make Roller, Roman, Balloon, And Austrian Shades* at least at page 82. It should then be appreciated that this method also presents similar problems and has other disadvantages. Specifically, such tapes are not readily available in all areas, and if available, the spacings of rings R are limited to what is available. Further, the ring tape is many times more expensive than just the rings. In addition, the use of ring tape requires the use of a sewing machine and thus results in the same and similar disadvantages as set forth with respect to the machine, zigzag stitch sewing of rings as discussed above, such as disadvantages resulting from requiring the sewer to cram a lot of material underneath the sewing machine. Furthermore, a major disadvantage of ring tapes is that they are not applicable to insulated Roman shades systems, a major market in regard to energy saving type window shades.

A method for attaching ring R to shades 10 is the use of H-shaped filament type attachment devices such as DENNISON barbs. Specifically, an H-shaped attachment device was obtained, and a leg or crossbar of the attachment device was inserted by an attachment gun through all layers of the shade at the desired location of the ring. The ring was then placed on the filament of the attachment device and the second leg or crossbar of the attachment device was then inserted by an attachment gun through all layers of the shade. This method is considerably better than sewing the rings on by hand or by sewing machines since the shade can remain flat on a table at all times so that there is no shifting in the layers as was common in sewing rings R to the shade 10. However, although this method is much less time consuming than sewing the rings on by hand or by utilizing a zigzag sewing machine, this method also presented problems and is otherwise disadvantageous. Specifically, this method requires a two step procedure and requires obtaining the rings and the filament type attachment device from two different sources. Furthermore, this type of attachment requires a certain degree of skill and often results in the installer poking his or her finger many times. Furthermore, inserting the second crossbar is very difficult, especially for persons with large fingers or with restricted use of the fingers. Thus, the use of H-shaped filament type attachment devices is similarly disadvantageous.

The present invention solves these and other problems and overcomes the disadvantages of prior ring attachment methods by providing a system of attachment in a one step procedure using an array of linearly connected and automatically distributed, one piece ring connectors 24. Specifically, connector 24 generally includes a T-shaped member having a leg or shank portion 26 having a first end 28 attached to ring R and a second end 30 attached to a crossbar 32. In the preferred embodiment of the present invention, crossbar 32 has the same orientation as, is parallel to, or lies in the same plane as ring R in connector 24. It should be noted that the length of the arms 34, or in other words the portions of crossbar 32 which extend beyond leg 26, have a length which is generally less than the length of leg 26. Therefore, connector 24 can be flexed allowing arm 34 of crossbar 32 to be folded into the area between ring R and end 30 of leg 26.

In its most preferred form, leg 26 has a length in the range of 0.125 inches which has been found to allow a tight fit with either an unquilted or regular Roman shade 10. In its most preferred form, and conforming to the above, crossbar 32 has a length in the range of 0.24 inches. It can then be appreciated that leg 26, crossbar 32, and ring R of connector 24 of the present system are made as a unitary piece. Therefore, ring R can be made of a smaller diameter because finger size is not relevant, which optimizes shade neatness since it is not necessary to attach a loose ring by sewing or by using an H-shaped filament type attachment device. Specifically, in the preferred embodiment, ring R has an inside diameter in the range of 0.25 inches.

According to the preferred embodiment of the connection system of the present invention, connectors 24 are linearly connected for automatic distribution in an array by a carrier bar 36 having a multiple of spaced connecting tongues 38. Tongues 38 are generally attached to crossbar 32 and in its most preferred form generally opposite to leg 26 and extend to and are attached to carrier bar 36. According to the system of the present invention, crossbar 32 of connectors 24 in the array are parallel to each other and are generally perpendicular to carrier bar 36. It can then be appreciated that rings R, connector 24, carrier bar 36 and tongues 38 can be made as a unitary piece such as by molding. Rings R, connector 24, carrier bar 36, and tongues 38 are formed of a material which has low surface friction, which is resistant to heat and cold, which is dry cleanable, and which has a high tensile strength. In the preferred embodiment rings R, connector 24, carrier bar 36, and tongues 38 are formed of nylon. In its most preferred form, carrier bar 36 has a length in the range of 3.88 inches, a height in the range of 0.055 inches, and a width in the range of 0.110 inches. Further, tongues 38 can include a reduced or break away portion 40 at the point of connection with connector 24 for allowing ease of separation of connector 24 from tongue 38 and carrier bar 36. In its most preferred form, tongues 38 are cylindrical in shape having a diameter in the range of 0.031 inches and are centered on carrier bar 36 every 0.160 inches. Thus, the preferred form includes 24 connectors 24 in the array. Reduced portion 40 in its most preferred form is also cylindrical in shape having a diameter in the range of 0.02 inches. The height of tongues 38 without reduced portion 40 is in the range of 0.055 inches in the most preferred form.

Now that the structure of the present system invention has been explained, the systemic method of attaching rings R to shades 10 and the further subtle features of the system of the present invention can be set forth and appreciated. Specifically, an attachment tool or gun 42 is obtained. Gun 42 can be of a variety of types such as those disclosed in U.S. Pat. Nos. 2,729,177; 2,952,851; 3,185,367; 3,650,452; 3,652,004; 3,893,612, and others. The array of connectors 24 can then be inserted into gun 42 with carrier bar 36 and tongues 38 being inserted into a first zone, crossbars 32 being inserted into a second zone, and legs 26 and rings R extending therebeyond. Therefore, tongues 38 can be engaged by a suitable feed mechanism for advancing the array of connectors 24 such that crossbars 32 can be serially aligned with and for introduction in a needle 44. Needle 44 is hollow and includes an elongated slot 46.

Figure 4:
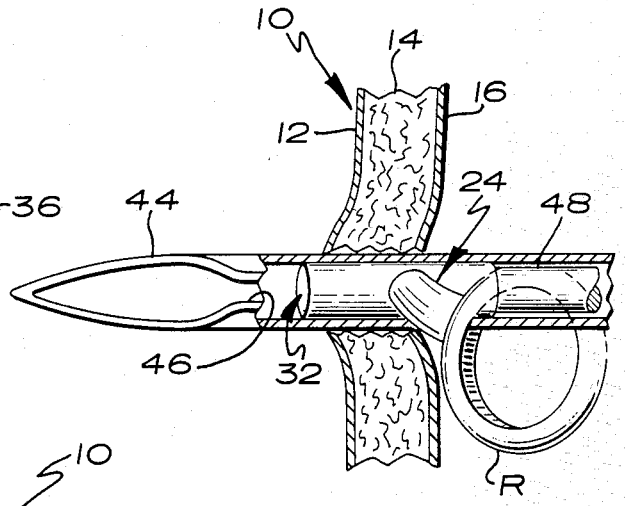
FIG. 4 shows a partial, cross sectional view of a ring connector being inserted through a shade according to the teachings of the present system invention.

After the array of connectors 24 has been inserted into gun 42, needle 44 can be inserted through shade 10 and specifically through layers of lining 16, batting 14, and fabric 12. At that time, gun 42 can be activated forcing a plunger or drive or push rod 48 against the end of crossbar 32 and moving crossbar 32 into needle 44. It can then be appreciated that due to the reduced portion 40 of tongue 38, crossbar 32 can break or tear away from tongue 38 of carrier bar 36 and thus separate from the array of connectors 24. With further movement of plunger 48 of gun 42, connector 24 is pushed through the needle 44 as seen in FIG. 4 of the drawings. It should then be appreciated that it is necessary to insert the entire length of crossbar 32 through shade 10. Thus, it is necessary for leg 26 to flex in regard to crossbar 32. Due to the shortened length of crossbar 32 in comparison to leg 26, leg 26 can pivot to almost a parallel relation to crossbar 32, with crossbar 32 not abutting with ring R.

Figure 5:
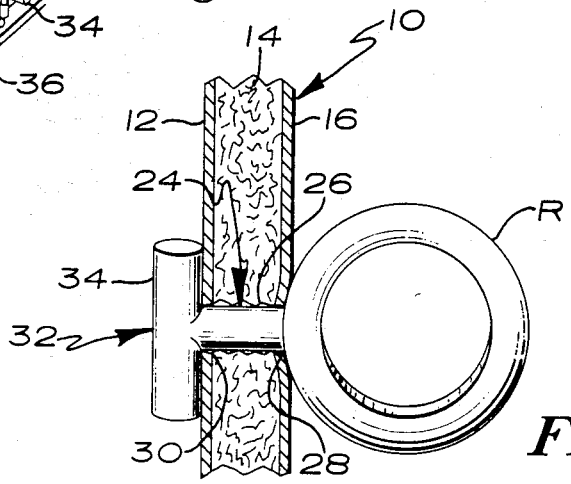
FIG. 5 shows a partial, cross section view of the shade of FIG. 1 according to section line 5—5 of FIG. 1.

While crossbar 32 is located within needle 44, crossbar 32 is generally perpendicular to the layers 12, 14, and 16 of shade 10. After crossbar 32 has passed through shade 10 in needle 44, crossbar 32 may be turned or automatically returns to its previous orientation such that arms 34 abut with fabric 12 as best seen in FIG. 5 and needle 44 of gun 42 can be removed. Crossbar 32 is then in a generally parallel relation to layers 12, 14, and 16 and generally abuts with fabric layer 12 of shade 10, and thus on the opposite side of the shade 10 than ring R. Therefore, crossbar 32 prevents removal of connector 24 from shade 10 in a first direction, ring R prevents removal of connector 24 from shade 10 in the opposite direction, and thus firmly attaching the pulling cord ring R to shade 10.

It can then be further appreciated that when plunger 48 of gun 42 is removed from needle 44, the next connector 24 of the array of connectors 24 is automatically positioned by the feed mechanism for alignment with and for insertion into needle 44.

It can now be appreciated that the one step attachment system of the present invention is highly advantageous over prior ring attachment methods. Specifically, the present system invention is a one step process which is considerably faster than prior attachment methods. For example, a Roman shade for a window that is forty inches wide by fifty-four inches long would require approximately 28 rings. It would then take at least one-half hour to hand sew on rings R as was previously done. But, utilizing connector 24 according to the teachings of the system of the present invention, rings R can be attached to shade 10 in less than five minutes, a sevenfold reduction in time. Furthermore, a sewing machine or other expensive machinery is not required by the present invention. Further, utilizing the teachings of the present invention, the shade can remain flat on the table at all times so that there is no shifting in the layers. Also, the present invention allows more accurate placement of rings R on shade 10 than prior ring attachments methods. Additionally, the present invention is applicable to all dimensions, types and styles of Roman shades. It should also be appreciated that connector 24 can pivot in shade 10 about shank 26 to allow ring R to automatically align with pull cords 18 and thus alignment is not as critical utilizing the present invention than in the prior attachment methods where rings R were not free to pivot and alignment was then an important consideration in the installation process. Therefore, the use of the system of the present invention including connectors 24 for attaching ring R to shade 10 is clearly highly advantageous over prior ring attachment methods.

Now that the basic teachings of the present invention have been explained, many extensions and variations will be obvious to one having ordinary skill in the art. Thus, since the invention disclosed herein may be embodied in other specific forms without departing from the spirit or general characteristics thereof, the embodiment described herein is to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. In connection with Roman type shades formed of multilayers of material and including pulling cords strung through rings attached to the shade such that the shade is generally flat when down and the shade falls into pleats when the pulling cords are pulled, the improved ring attachment system comprising: ring attachment devices comprising, in combination: an array of linearly connected, automatically distributing, ring connectors formed integrally with an array of rings, with the ring connectors including a T-shaped member having a shank portion including a first end and a second end and having a crossbar including a first end and a second end, with the first end of the shank portion being integrally attached to the ring, with the second end of the shank portion being integrally attached to the crossbar substantially midway between the first and second ends of the crossbar; with the ring connectors being connected in the array by a carrier bar having a multiplicity of integrally formed tongues, each tongue having a free end, with the free ends of the tongues being integrally attached to the crossbars of the ring connectors generally opposite of the connection of the shank with the crossbar and with the crossbars of the array of connectors being generally parallel to each other and perpendicular to the carrier bar; and an attachment tool comprising, in combination: a hollow needle having a slot, means for automatically feeding the array of connectors serially to the hollow needle for aligning the crossbar of the connector generally parallel to, aligned with, and for introduction into the needle and for aligning the shank portion with and for introduction into the slot of the hollow needle; and means for forcing the crossbar of the ring connector into and through the needle and moving the shank portion of the ring connector into and through the slot of the hollow needle for inserting the shank portion of the ring connector through the multilayers of Roman shade material and for positioning the crossbar to be parallel and abut with the multilayers of material on the opposite side of the shade from the ring for preventing the shank portion of the ring connector from being pulled from the shade by the abutment of the crossbar with shade material and thus firmly attaching the ring to the shade in a one step operation.

2. The system of claim 1 wherein the length of the crossbars which extend beyond the shank portion of the ring connector is shorter than the length of the shank portion allowing the shank portion of the ring connector to be flexed in relation to the crossbar of the ring connector to be folded generally parallel to the crossbar between the first and second ends of the shank portion when the crossbar of the ring connector is being forced through the hollow needle and the shank portion of the ring connector is being forced through the slot of the hollow needle when the shank portion is being inserted through the multilayers of material of the shade.

3. The system of claim 1 wherein the length of the shank portion is in the range of 0.125 inches allowing a tight fit with either an unquilted or regular Roman type shade.

4. The system of claim 1 wherein the free ends of the tongues include a reduced portion for allowing ease of separation of the ring connector from the tongue when the crossbar is forced into the needle.

5. The system of claim 1 wherein the rings are circular in shape and have an inside diameter in the range of 0.25 inches to optimize shade neatness.

* * * * *